US007647880B2

(12) United States Patent
Devine

(10) Patent No.: US 7,647,880 B2
(45) Date of Patent: Jan. 19, 2010

(54) ADJUSTABLE BOAT LEANING POST MOUNTING SYSTEM

(75) Inventor: Robert Devine, West Babylon, NY (US)

(73) Assignee: Chem-Tainer Industries, Inc., West Babylon, NY (US)

( * ) Notice: Subject to any disclaimer, the term of this patent is extended or adjusted under 35 U.S.C. 154(b) by 59 days.

(21) Appl. No.: 12/011,916

(22) Filed: Jan. 29, 2008

(65) Prior Publication Data

US 2009/0188421 A1 Jul. 30, 2009

(51) Int. Cl.
*B63B 17/00* (2006.01)
*A47C 15/00* (2006.01)
*A47C 7/02* (2006.01)

(52) U.S. Cl. ..... 114/363; 297/232; 297/257; 297/452.4

(58) Field of Classification Search ..... 114/363; 297/232, 257, 452.4
See application file for complete search history.

(56) References Cited

U.S. PATENT DOCUMENTS 2,478,042 A * 8/1949 Elling ..... 114/348
4,566,734 A * 1/1986 Bruner ..... 297/344.14
4,700,921 A * 10/1987 Holbrook ..... 248/421
4,709,649 A * 12/1987 Wann ..... 114/363

* cited by examiner

*Primary Examiner*—Daniel V Venne
(74) *Attorney, Agent, or Firm*—Duncan Palmatier

(57) ABSTRACT

The present invention relates to an adjustable mounting system for a leaning post for a boat having a pair of side-by-side seat posts. The leaning post is provided with a pair of brackets to which hollow cylindrical support posts can be adjustably mounted. The spacing between the support posts can be adjusted to align with the spacing of a pair of conventional hollow cylindrical side-by-side vertical seat posts. A pair of spaced apart parallel slots in the mounting brackets receive bolts that secure the support posts to the mounting bracket and allow the distance between the support posts to be adjusted to align with the distance between the seat posts.

9 Claims, 6 Drawing Sheets

ADJUSTABLE BOAT LEANING POST MOUNTING SYSTEM

FIELD OF THE INVENTION

The present invention relates to an adjustable mounting system for a boat leaning post.

BACKGROUND OF THE INVENTION

Boats, especially fishing boats, often provide pairs of side-by-side seats removably mounted to vertical posts. FIG. 1 shows such an arrangement. In this illustration, an open fishing boat 1 has a center console 2 in front of which two seats 3 are disposed side-by-side. The seats 3 are removably mounted atop vertical posts 5. The posts 5 are secured to the deck 4 by mounting bases 6. Each mounting base 6 is fixed to the deck 4, by screws or bolts. Because boats come in many styles and sizes from a variety of different manufacturers, the spacing between posts 5 varies.

Individual seats of the general type shown as 3 in FIG. 1 are not designed to be useful for other purposes, such as holding fishing rods, providing storage, offering gripping bars, and other similar purposes. It is sometimes desirable to substitute a bench for the seats in order to provide a sitting and leaning surface that also provides a variety of other useful functions. These benches are generally known as a "leaning post". The wider leaning posts require two vertical posts for support. Because many boats include two, side-by-side vertical posts 5 for individual seats, these can be used to support a leaning post bench. However, these pairs of side-by-side posts 5 are fixed by mounting bases 6 to the deck 2 of a boat 1 at different spacings for each boat. To substitute a leaning post bench for the individual seats 3, the mounting brackets under the leaning post bench must be adapted to the spacing provided by the posts on a particular boat. Usually, the boat owner must measure the spacing between the seat posts 5, then fix the mounting brackets to the bottom of the leaning post bench. This mounting process can involve drilling holes into the bottom of the leaning post bench and requires careful measurement and installation. This is not a simple undertaking for many boat owners.

SUMMARY OF THE INVENTION

Therefore, it is an object of the present invention to provide an adjustable mounting system for a boat leaning post bench that sits atop two boat seat posts. It is another object to make the adjustable mounting system simple and easy for boat owners to install.

In accordance with these objectives, the present invention provides a boat leaning post bench with mounting brackets that can be adjusted for a variety of side-by-side seat post spacings.

DETAILED DESCRIPTION OF THE PREFERRED EMBODIMENT

Figure 1:
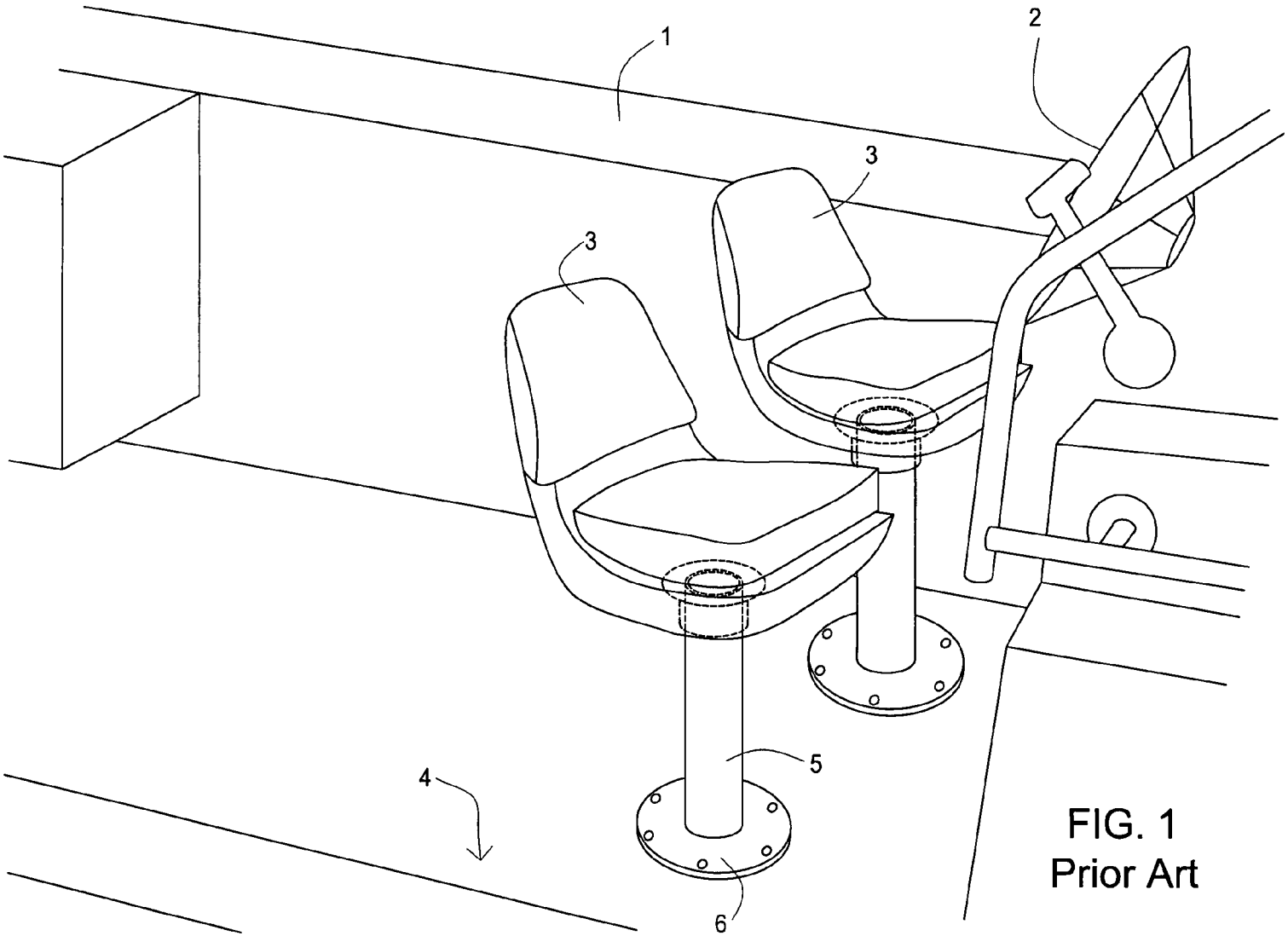
FIG. 1 Prior Art
FIG. 1 is a perspective view of a pair of side-by-side seats disposed on the deck of a boat in a conventional way.
Figure 2:
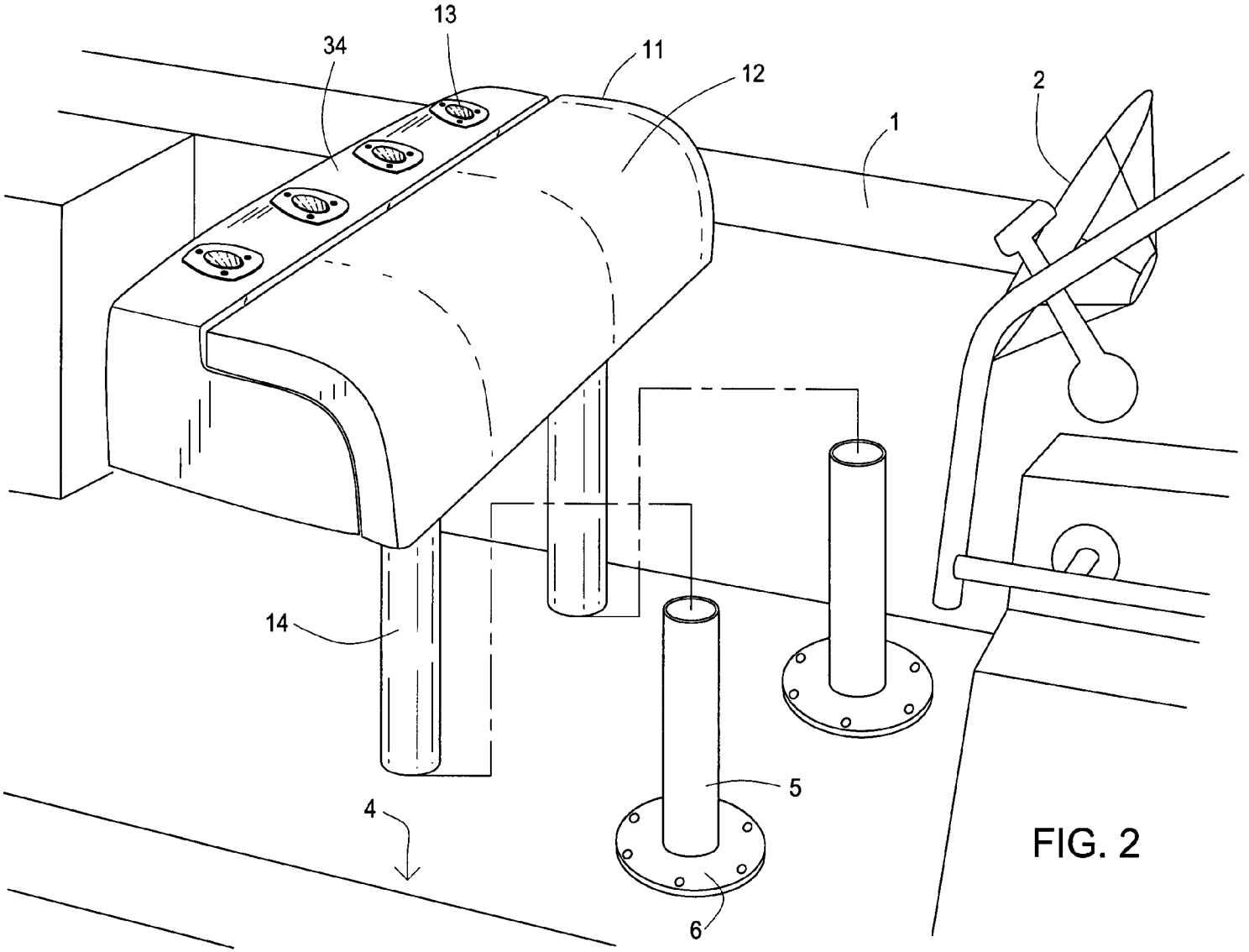
FIG. 2 is a perspective view of the adjustable mounting system for a boat leaning post of the present invention.
Figure 4:
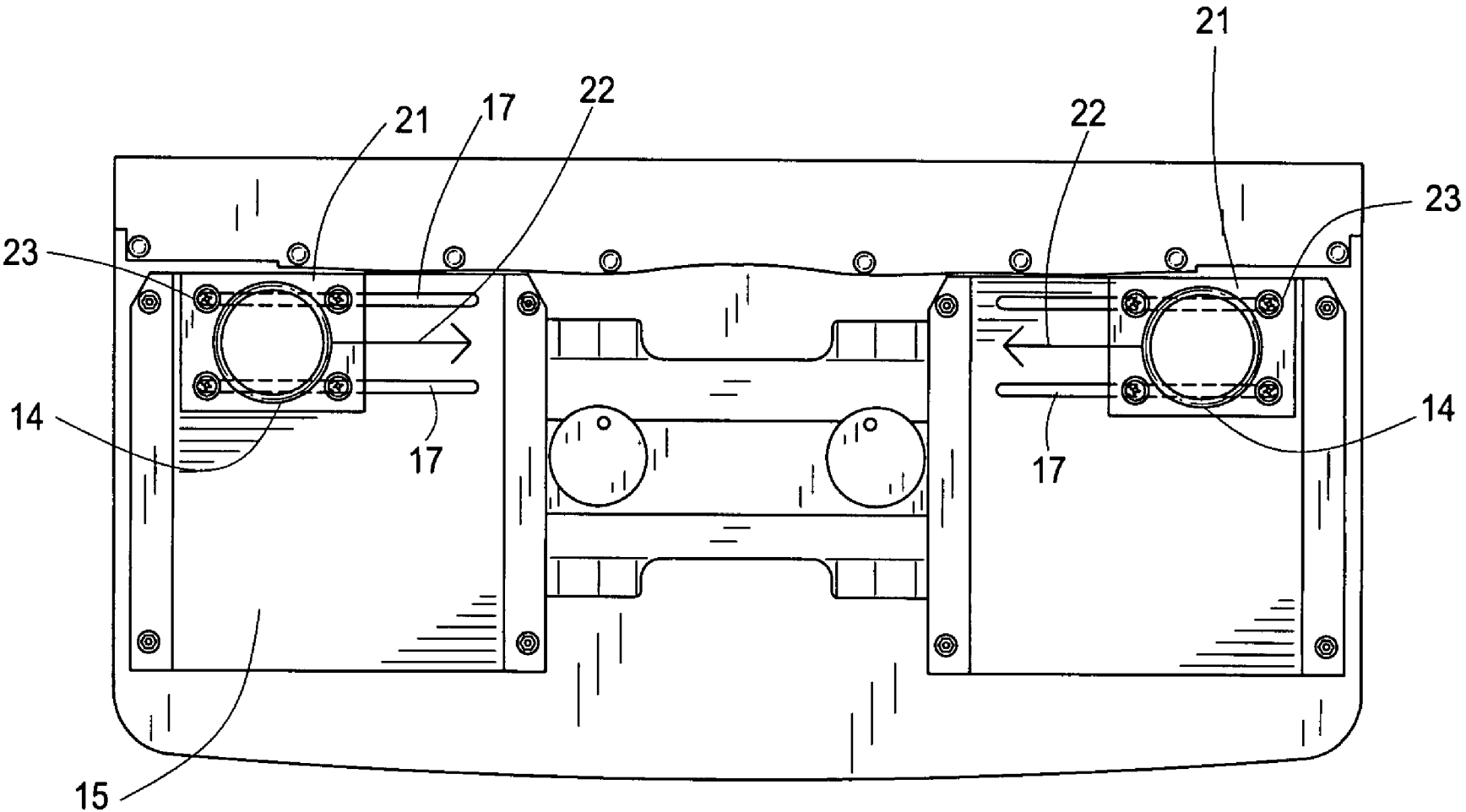
FIG. 4 is a view of the bench posts adjustably disposed on the mounting bracket on the bottom of a boat leaning post bench according to the present invention.
Figure 6:
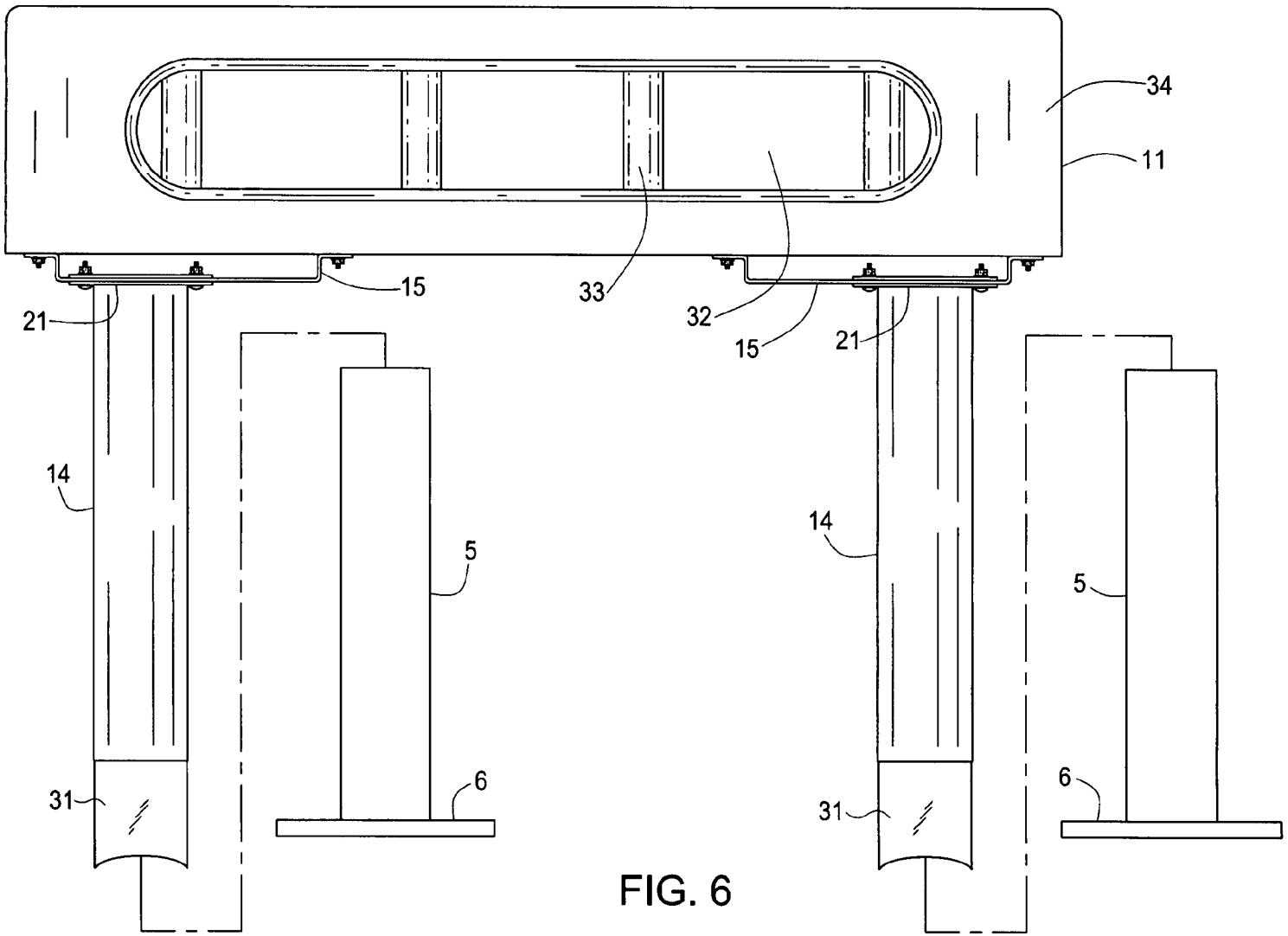
FIG. 6 is a back view showing how the adjustable mounting posts of the present invention are arranged for coupling with the side-by-side seat posts of a conventional boat.

FIG. 1 shows an open fishing boat 1 with a center console 2, in front of which two seats 3 are disposed side-by-side. The seats 3 are removably mounted atop vertical posts 5 secured to the deck 4 by mounting bases 6. The seats 3 can be removed from the posts 5, as shown in FIG. 2. FIG. 2 shows a leaning post 11 of the wider, bench type. The leaning post can be made of molded plastic. Leaning post 11 has a cushion 12, arranged over part of the top and front, on or against which a person can sit or lean. At the back of the leaning post 11, a portion of the top 34 includes recesses 13, opening into hollow cylindrical tubes 33, into which fishing rods (not shown) or the supports for a backrest (not shown) can be inserted. It will be appreciated that the box-like structure of the plastic leaning post bench 11 affords space inside for storage. FIG. 6 shows an opening 32 at the back 34 of the leaning post 11 to access this storage space. As seen in FIG. 2, leaning post 11 has two mounting bench posts 14 disposed downwardly from the bottom. As seen in FIGS. 2 and 4, bench posts 14 are hollow cylinders that fit over cylindrical boat posts 5. It will be appreciated that, for the purposes of the present invention, it makes no difference whether cylindrical bench post 14 fits over or within cylindrical boat post 5. As described in connection with the preferred embodiment, these bench posts 14 are intended to fit over the side-by-side seat posts 5 of the boat 1.

Figure 3:
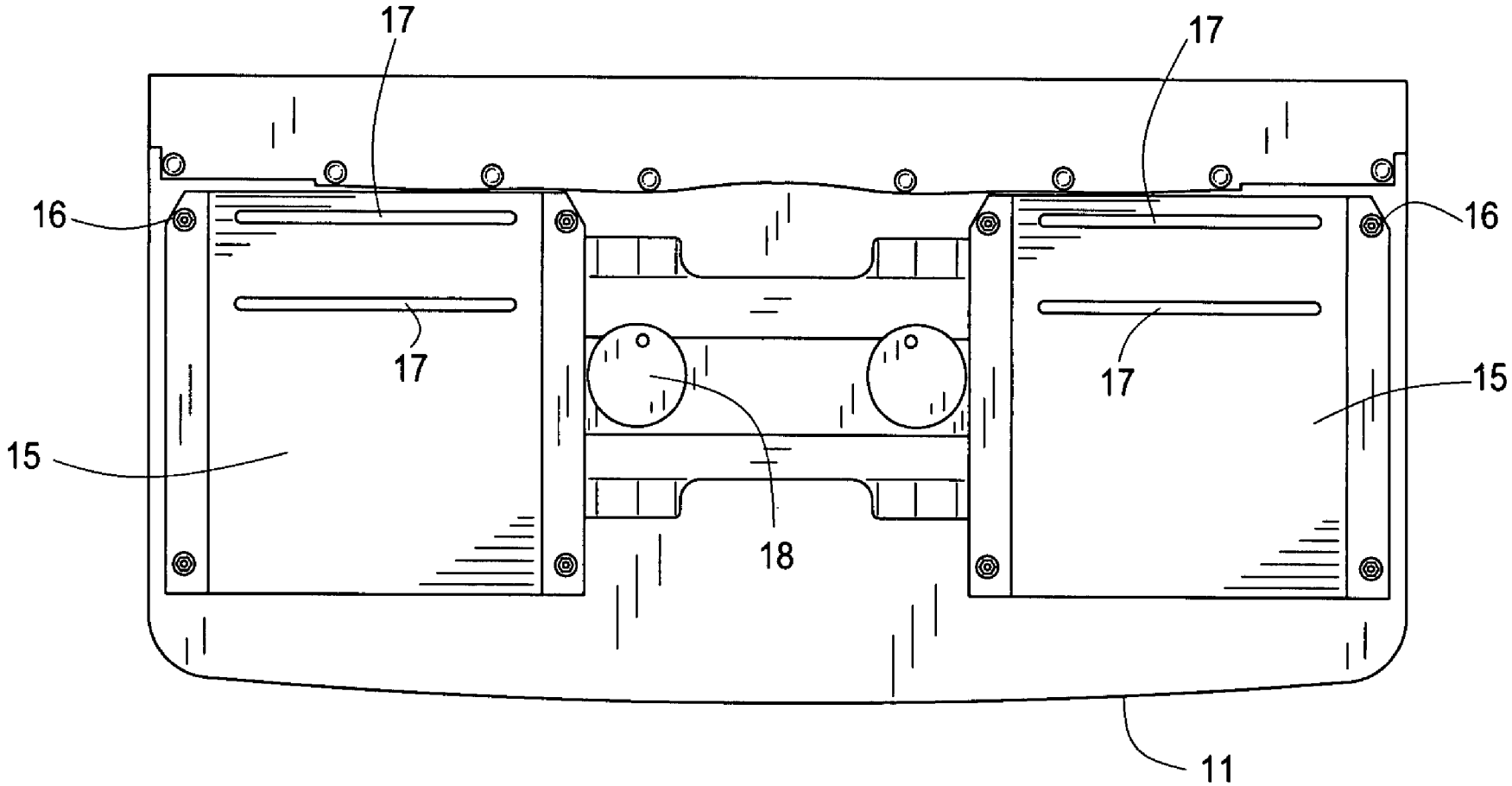
FIG. 3 is a view of the mounting bracket secured to the bottom of a boat leaning post bench according to the present invention.
Figure 5:
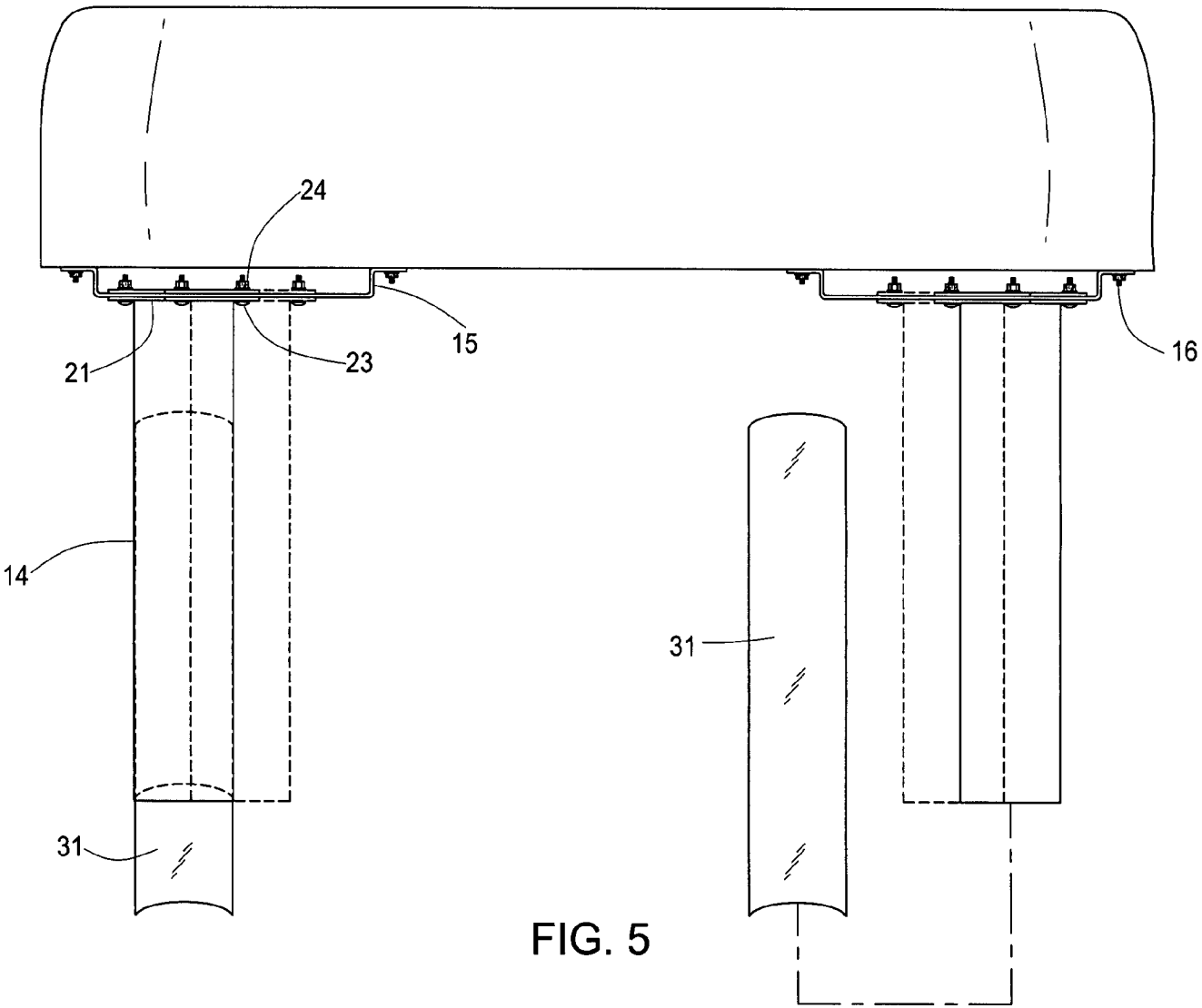
FIG. 5 is a front view of the bench posts adjustably disposed to the mounting bracket of a boat leaning post bench according to the present invention.

FIG. 3 shows the bottom of the leaning post 11. Two mounting brackets 15 are secured at either side of the leaning post 11 bench by fasteners 16, such as screws or nuts and bolts. The mounting brackets 15 are, preferably, made of stainless steel or some other non-corrosive material that can withstand the effects of salt water exposure and provide adequate structural support for the bench posts 14 (seen in FIG. 4). Although mounting brackets 15 are shown in the preferred embodiment as separate from the leaning post 11, it will be appreciated that the mounting bracket 15 structures could be incorporated into the leaning post 11 itself, either by molding metal brackets 15 with the leaning post 11, or by making the mounting brackets 15 part of the leaning post 11. Mounting brackets 15 each have a pair of parallel grooves 17 running along the side-to-side length of the leaning post bench 11. As seen in FIG. 5, mounting bracket 15 is stepped, so that a space is created between the bottom of the leaning post 11 and the mounting bracket 15.

FIG. 4 shows how the bench posts 14 are adjustably mounted to the mounting brackets 15. Each bench post 14 has a square mounting plate 21 at its top end. The mounting plate 21 has holes at each corner through which fasteners 23, such as bolts, extend. Bolts 23 are aligned with the grooves 17 in the mounting bracket 15. As shown in FIG. 5, corresponding fasteners 24, such as nuts, clamp the mounting plate 21 to the mounting bracket 15. Returning to FIG. 4, it will be appreciated that the grooves 17 allow the bench posts 14 to be moved a distance 22 along the side-to-side length of the leaning post bench 11, and this movement adjusts the spacing between the two bench posts 14.

FIG. 5 shows the adjustability of the distance between the bench posts 14. Thus, at one extreme, the bench posts 14, shown in solid lines, are spaced at a wide distance from each other. At the other extreme, the bench posts 14, shown in broken lines, are spaced at a narrow distance from each other. This adjustability allows the distance between the bench posts 14 to be changed.

FIG. 5 also shows shims 31, which can be placed inside bench posts 14 to prevent wobbling when the bench posts 14 are slid onto the boat posts 5, as described below. These shims can be made of plastic or similar non-corrosive material, which provides shimming and prevents the metal boat post 5 and bench post 14 from rubbing against each other, which can cause wearing and squeaking.

FIG. 6 shows that, when bench posts 14 are adjusted to the appropriate distance they slide over boat posts 5, with shims 31 inserted between them.

The drawings and description set forth here represent only some embodiments of the invention. After considering these, skilled persons will understand that there are many ways to make an adjustable leaning post according to the principles disclosed. The inventor contemplates that the use of alternative structures, materials, or manufacturing techniques, which result in an adjustable leaning post according to the principles disclosed, will be within the scope of the invention.

What I claim is:

1. An adjustable mounting system for a leaning post for a boat having a pair of hollow cylindrical side-by-side seat posts extending vertically from a deck of the boat, comprising:

an elongated leaning post bench having a substantially rectangular box shape formed by a top surface, a front surface, a back surface, a bottom surface, side surfaces at each end of the elongated bench, and an inside space enclosed by said top, front, bottom and side surfaces, a pair of mounting brackets incorporated in the bottom surface of the elongated bench, each mounting bracket comprising a downward-facing surface directed away from the bottom of the bench toward the deck of the boat, wherein each mounting bracket further comprises a pair of parallel spaced apart grooves aligned in a lengthwise direction from one side of the elongated bench to the other side, a pair of bench posts each comprising a hollow elongated cylindrical body, a top end, an open bottom end, a mounting plate disposed at said top end, and at least two fasteners arranged to secure the mounting plate to each of the pair of parallel spaced apart grooves, wherein the cylindrical bodies of said bench posts are sized for sliding engagement with said pair of hollow side-by side cylindrical seat posts, wherein the mounting plates of said bench posts mount adjustably to the pairs of parallel spaced apart grooves in the downward-facing surface of the mounting bracket so that the pair of bench posts can be adjusted to align with the pair of side-by-side seat posts, and wherein the fasteners secure the mounting plate of the bench posts to the mounting bracket.

2. The adjustable mounting system for a leaning post for a boat of claim 1 wherein the downward-facing surface of the mounting brackets further comprise at least two opposite sides, a sidewall at each of the sides of the mounting bracket, said sidewall extending at a substantially right angle to the downward-facing surface in a direction toward the bottom of the elongated bench, wherein the mounting bracket is incorporated in the bottom of the elongated bench at the sidewalls, and wherein a space is created between the bottom of the elongated bench, an upwardly-facing surface opposite the downwardly-facing surface of the mounting bracket, and the sidewalls of the mounting bracket.

3. The adjustable mounting system for a leaning post for a boat of claim 1 wherein the fasteners further comprise a nut and bolt.

4. The adjustable mounting system for a leaning post for a boat of claim 1 wherein the hollow elongated cylindrical body of at least one of the bench posts is sized to mount slidably over one of the hollow cylindrical seat posts.

5. The adjustable mounting system for a leaning post for a boat of claim 1 wherein the hollow elongated cylindrical body of at least one of the bench posts is sized to mount slidably within one of the hollow cylindrical seat posts.

6. The adjustable mounting system for a leaning post for a boat of claim 1 further comprising at least one shim disposed between the hollow elongated cylindrical body of the bench posts and the hollow cylindrical seat posts.

7. The adjustable mounting system for a leaning post for a boat of claim 6 wherein the shim is a sheet of plastic.

8. The adjustable mounting system for a leaning post for a boat of claim 1 further comprising an opening in the back surface of the elongated bench, said opening providing access to the inside space of the elongated bench.

9. The adjustable mounting system for a leaning post for a boat of claim 1 wherein the top surface of the elongated bench further comprises a rear portion adjacent the back surface, wherein the rear portion comprises at least one opening forming a hollow cylindrical tube extending downwardly within the inside space of the elongated bench, said tube sized to receive a fishing rod or a back rest support.

* * * * *